United States Patent [19]

Hiyama et al.

[11] Patent Number: 4,538,132

[45] Date of Patent: Aug. 27, 1985

[54] IMPEDANCE CONVERTING TRANSFORMER FORMED OF CONDUCTORS EXTENDING THROUGH A MAGNETIC HOUSING

[75] Inventors: Torao Hiyama, Haramachi; Kazuo Nishizawa, Koide, both of Japan

[73] Assignee: Alps Electric Co., Ltd., Japan

[21] Appl. No.: 423,240

[22] Filed: Sep. 24, 1982

[30] Foreign Application Priority Data

Oct. 6, 1981 [JP] Japan ..... 56-148313[U]

[51] Int. Cl.[3] ..... H01H 85/46

[52] U.S. Cl. ..... 336/221; 336/232; 336/223

[58] Field of Search ..... 336/200, 221, 223, 232

[56] References Cited

U.S. PATENT DOCUMENTS

| | | | |
|---|---|---|---|
| 3,413,716 | 12/1968 | Schwertz et al. | 336/200 X |
| 3,500,252 | 3/1970 | Wakker | 336/223 X |
| 3,638,156 | 1/1972 | West | 336/223 X |
| 4,052,785 | 10/1977 | Duncan | 336/29 |
| 4,383,235 | 5/1983 | Layton et al. | 336/223 X |

FOREIGN PATENT DOCUMENTS

| | | | |
|---|---|---|---|
| 666920 | 10/1938 | Fed. Rep. of Germany | 336/223 |
| 1489053 | 6/1964 | Fed. Rep. of Germany | 336/223 |
| 2343539 | 4/1974 | Fed. Rep. of Germany | 336/200 |
| 1482715 | 6/1966 | France | 336/221 |
| 110009 | 8/1980 | Japan | 336/200 |

*Primary Examiner*—Reinhard J. Eisenzopf

*Attorney, Agent, or Firm*—Guy W. Shoup; Gerard F. Dunne

[57] ABSTRACT

A transformer is disclosed. The transformer consists essentially of first and second conductors, each having at least three overlap portions, terminals at one end each of the overlap portions and a connecting portion for connecting the other end of each of the overlap portion; an insulating member interposed between the first and second conductors, thereby forming an electromagnetic coupling; and two cores mode of a magnetic substance, at least one of the cores having three grooves; the overlap portions of the first and second conductors being placed in the grooves of the core while being electrically insulated from one another by the insulating member; the two cores being bonded to each other with the overlap portions between them.

4 Claims, 13 Drawing Figures

IMPEDANCE CONVERTING TRANSFORMER FORMED OF CONDUCTORS EXTENDING THROUGH A MAGNETIC HOUSING

BACKGROUND OF THE INVENTION

This invention relates to a transformer suitable for use in high frequency appliances and more specifically, the invention is directed to reduce the number of manual steps in producing the transformer, to make possible production of the transformer by greater use of machines so as to reduce the cost of production and to provide the products having uniform characteristics.

FIG. 1 illustrates diagrammatically an example of the conventional balance-unbalance conversion transformer for use in the range of a VHF band to a UHF band.

FIG. 1 is a perspective view of the conventional transformer and FIG. 2 is its equivalent circuit diagram. As is obvious from FIG. 2, a signal source 13 and a signal source impedance 14 are connected to the input terminals 1*a*, 2*a* of a first transformer $T_1$ so as to convert an unbalanced signal into a balanced signal by the first transformer $T_1$. Input terminals 5*a*, 8*a*, 6*a*, 9*a* of a second transformer $T_2$ are connected to the output terminals 1*b*, 2*b* of the first transformer $T_1$. This second transformer $T_2$ effects the impedance conversion at a ratio of 1:4. A load 15 is connected to the output terminals 5*b*, 9*b* of the second transformer $T_2$.

In other words, a value four times the signal source impedance 14 appears as a value at the load 15.

In FIG. 2, further, the input terminal 2*a* of the first transformer $T_1$ is grounded and the junction between the output terminals 6*b*, 8*b* of the second transformer $T_2$ is grounded.

When the load 15 is a balance mixer diode or the like, the output terminals 6*b*, 8*b* are not grounded but are used as the input terminals of a local oscillation signal.

As depicted in FIG. 1, the transformer comprises the first transformer $T_1$ which is formed by winding a paired wire 3 consisting of copper wires 1 and 2, that are insulation-coated in parallel and in intimate contact with each other, on a ring-like toroidal core 4 and the second transformer $T_2$ which is formed by winding a paired wire 7 consisting of copper wires 5 and 6, that are insulation-coated in parallel and in intimate contact with each other, as well as a paired wire 10 consisting of copper wires 8 and 9, that are insulation-coated in parallel and in intimate contact with each other, on another ring-like toroidal core 11. The start and end of each of the paired wires 3, 7, 10 are bonded to the toroidal cores 4, 11, respectively, by use of an adhesive 12 in order to prevent them from getting loose and rewinding. One end each of the copper wires 1, 2, 5, 6, 8, 9 of each of the paired wires 3, 7, 10 is used as the input terminal 1*a*, 2*a*, 5*a*, 6*a*, 8*a*, 9*a* while the other end each of the copper wires is used as the output terminal 1*b*, 2*b*, 5*b*, 8*b*, 9*b*. The output terminal 1*b* of the copper wire 1 of the first transformer $T_1$ is wired to the input terminals 5*a*, 8*a* of the copper wires 5, 8 of the second transformer $T_2$ and the output terminal 2*b* of the copper wire 2 of the first transformer $T_1$ is connected to the input terminals 6*a*, 9*a* of the copper wires 6, 9 of the second transformer $T_2$. Furthermore, the output terminals 6*b*, 8*b* of the copper wires 6, 8 of the second transformer $T_2$ are connected to each other.

In the conventional transformer having the construction described above, the paired wires 3, 7, 10 are wound on the ring-like toroidal cores 4, 11 so that winding must be made manually and automation is difficult to attain. This is because high frequency appliances generally use toroidal cores 4, 11 having an inner diameter as small as about 2 mm and a practical automatic winding machine for winding such an extremely small core has not yet been available.

Since the paired wires 3, 7, 10 must be wound manually, the winding pitch does not become uniform but causes non-uniformity, resulting in variance in the characteristics of the products. Furthermore, since the two transformers $T_1$, $T_2$ are produced by winding separately the wires on the two toroidal cores 4, 11 and then connecting the transformers by use of a large number of wires, productively is extremely low and hence, the production cost becomes inevitably high.

SUMMARY OF THE INVENTION

The present invention is therefore directed to eliminate all these problems with the prior art and to provide a transformer which is simple in construction, reduces the number of wiring work required conventionally, and can be productively with an extremely high efficiency and at a reduced cost of production.

The other objects and features of the present invention will become more apparent from the following description to be taken in conjunction with the accompanying drawings.

BRIEF DESCRIPTION OF THE DRAWINGS

FIGS. 3 through 6 illustrate one embodiment of the present invention, in which:

FIG. 3 is a plan view of the transformer;

FIG. 4 is a sectional view of the principal portions;

FIG. 5 is an exploded perspective view; and

FIG. 6 is its equivalent circuit diagram.

FIGS. 7 through 9 illustrate an electromagnetic coupling in accordance with another embodiment of the present invention, in which:

FIG. 7 is a plan view of the electromagnetic coupling;

FIG. 8 is its rear view;

FIGS. 9B and 9C are its side views.

DESCRIPTION OF THE PREFERRED EMBODIMENTS

Figure 1:
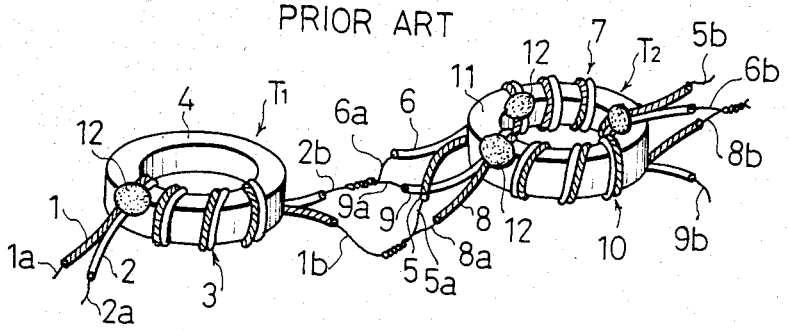
Fig.1 PRIOR ART
FIG. 1 is a perspective view of the conventional transformer.

One embodiment of the present invention will be first described with reference to FIGS. 3 through 6. Reference numeral 20 represents an electromagnetic coupling which consists of first and second conductors 21, 22 having a substantially -shape, and an insulating member 23 interposed between the first and second conductors 21, 22 and electrically insulating them from each other. The first conductor 21 of the electromagnetic coupling has three linear overlap portions 21*a*, 21*b*, 21*c*, terminals 21*d*, 21*e*, 21*f* positioned at one open end each of these overlap portions 21*a*, 21*b*, 21*c* and a connecting together portion 21*g* for connecting the other ends of the overlap portions 21*a*, 21*b*, 21*c*.

The second conductor 22 has likewise three linear overlap portions 22*a*, 22*b*, 22*c*, terminals 22*d*, 22*e*, 22*f* positioned at one open end each of the overlap portions 22*a*, 22*b*, 22*c* and a connecting portion 22*g* for connecting the other end of each of the overlap portions 22*a*, 22*b*, 22*c*. The overlap portions 22*a*, 22*b*, 22*c* of the second conductor 22 are formed such that they can be superposed with the overlap portions 21*a*, 21*b*, 21*c* of the first conductor 21, respectively, and their inside length $l_2$ is greater than the outside length $l_1$ of the overlap portions 21*a*, 21*b*, 21*c* of the first conductor 21. Accordingly, when the first and second conductors 21 and 22 are placed over one another, the connecting portion 21*g* of the first conductor 21 and the connecting portion 22*g* of the second conductor 22 do not overlap with each other.

When the first and second conductors 21 and 22 are placed over one another the terminals 21D and 22D 21E and 22E and 21F and 22F of the first and second conductors 21, 22 are spaced apart from, and oppose, one another, but the terminals 21f and 22e overlap with each other.

The insulating member 23 has a -shape and is equipped with insulating plates 23*a*, 23*b*, 23*c* placed between the overlap portions 21*a*, 21*b*, 21*c* and 22*a*, 22*b*, 22*c* of the first and second conductors 21, 22, and with connecting plates 23*d*, 23*e* for connecting both ends of the insulating plates 23*a*, 23*b*, 23*c*. The inside length $l_3$ of the insulating plates 23*a*, 23*b*, 23*c* is substantially equal to the inner length $l_3$ of the overlap portions 21*a*, 21*b*, 21*c* of the first conductor 21.

Reference numerals 24 and 25 represent cores that are made of a magnetic substance and encase the overlap portions 21*a*, 21*b*, 21*c* and 22*a*, 22*b*, 22*c* of the first and second conductors 21, 22. One 24 of the cores has a flat sheet-like shape but the other 25 has an E-shape equipped with three grooves 25*a*, 25*b*, 25*c* for receiving therein the overlap portions 21*a*, 21*b*, 21*c* and 22*a*, 22*b*, 22*c* of the first and second conductors 21, 22 and the insulating plates 23*a*, 23*b*, 23*c* of the insulating member 23. The length $l_3$ of each core 24, 25 is equal to the length $l_3$ of the insulating plate 23 and the inner length $l_3$ of the overlap portions 21*a*, 21*b*, 21*c* of the first conductor 21.

The transformer in accordance with the present invention can be assembled in the following manner. First, the overlap portions 22*a*, 22*b*, 22*c* of the second conductor 22, the insulating plates 23*a*, 23*b*, 23*c* of the insulating member 23 and the overlap portions 21*a*, 21*b*, 21*c* of the first conductor 21 are inserted sequentially in the order named into the grooves 25*a*, 25*b*, 25*c* of the core. The flat sheet-like core 24 is then placed over the first conductor 21 and the electromagnetic coupling 20 is interposed between the two cores 24, 25. Finally, the assembly is completed by bonding one 24 of the cores to the other 25 by a suitable fixing member (not shown).

Figure 3:
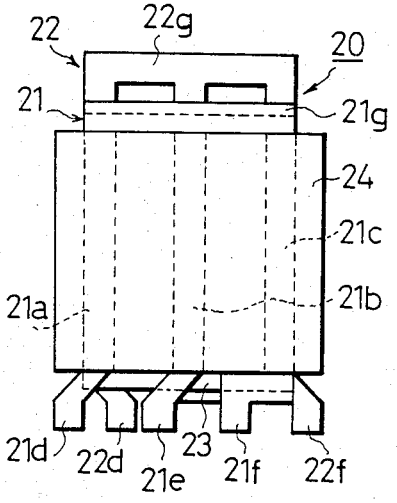
Figure 4:
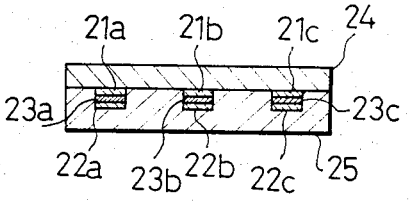

As is obvious from FIG. 3, after completion of assembly, the terminals 21*d*, 21*e*, 21*f* and 22*d*, 22*e*, 22*f* of the first and second conductors 21, 22 are spaced apart from, and oppose, one another and their connecting portions 21*g*, 22*g* do not over lie each other. Furthermore, the overlap portions 21*a*, 21*b*, 21*c* and 22*a*, 22*b*, 22*c* of the first and second conductors 21, 22 are electrically insulated from one another by the insulating plates 23*a*, 23*b*, 23*c*. The second conductor 22 having a relatively greater size is kept in place by suitable means such as an adhesive so as to prevent the deviation of its position. In the transformer having the construction described above, the conventional first transformer $T_1$ is formed by the overlap portions 21*a* and 22*a* of the first and second conductors 21, 22 and the conventional transformer $T_2$ is formed by the overlap portions 21*b*, 21*c* and 22*b*, 22*c* of the first and second conductors. The equivalent circuit diagram is shown in FIG. 6.

Figure 5:
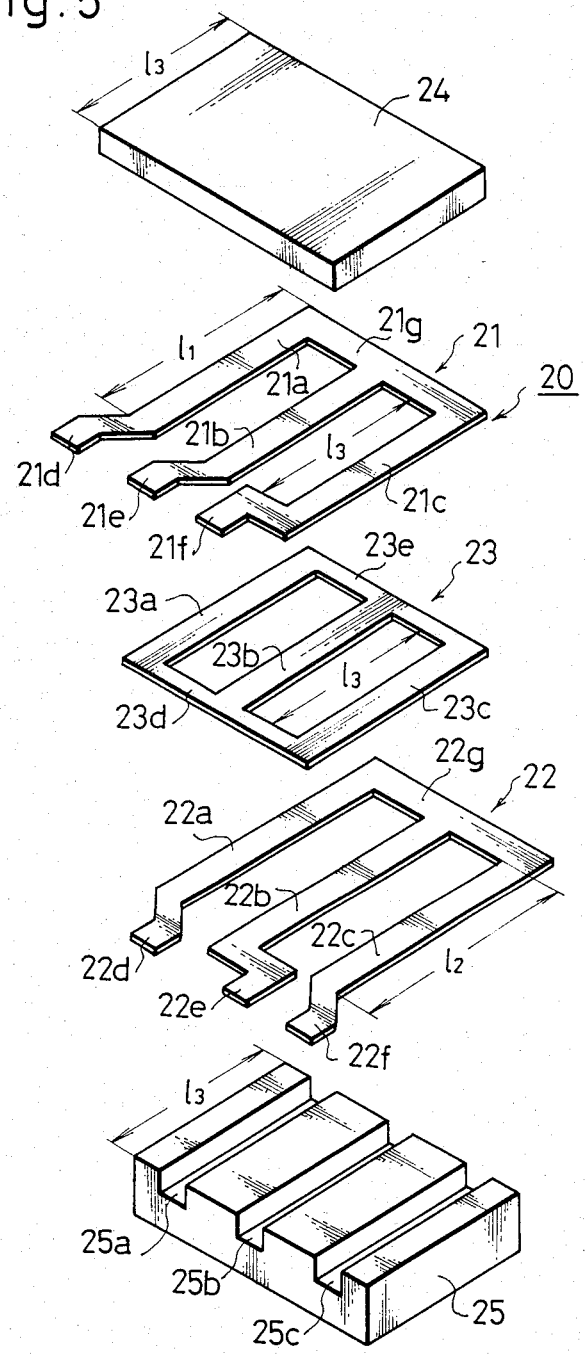

The constituent members of the transformer of the present invention shown in this equivalent diagram and in FIG. 5 correspond to the constituent members of the conventional transformer in the following way:

| | | |
|---|---|---|
| overlap portion 21a | → | copper wire 1 |
| overlap portion 21b | → | copper wire 5 |
| overlap portion 21c | → | copper wire 8 |
| overlap portion 22a | → | copper wire 2 |
| overlap portion 22b | → | copper wire 6 |
| overlap portion 22c | → | copper wire 9 |
| terminal 21d | → | input terminal 1a |
| terminal 22d | → | input terminal 2a |
| terminal 21e | → | output terminal 5b |
| terminal 21f | → | output terminal 8b |
| terminal 22e | → | output terminal 6b |
| terminal 22f | → | output terminal 9b |
| connecting portion 21g | → | output terminal 1b and input terminals 5a, 8a |
| connecting portion 22g | → | output terminal 2b and input terminals 6a, 9a |

Figure 2:
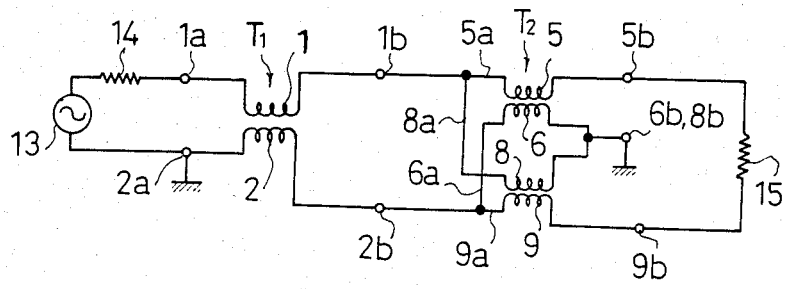
Fig.2 PRIOR ART
FIG. 2 is its equivalent circuit diagram.
Figure 6:
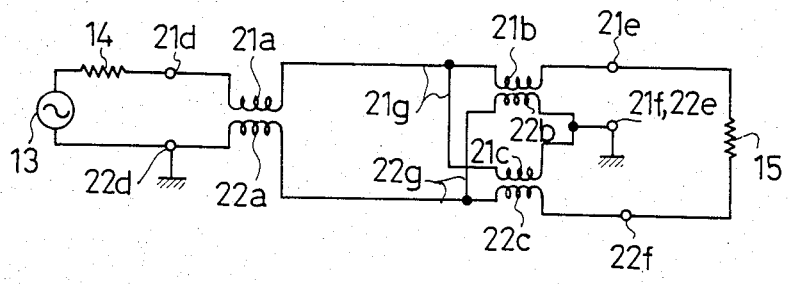

The equivalent circuit diagram shown in FIG. 6 is exactly the same as the conventional equivalent circuit diagram shown in FIG. 2. Moreover, in the transformer in accordance with the present invention, the connecting portions 21*g* and 22*g* eliminate the wiring work between the conventional first and second transformer $T_1$ and $T_2$.

The electromagnetic coupling 20 in the embodiment described above can be produced by punching a metallic plate such as an iron plate to form the first and second conductors 21, 22 and punching also an insulating plate such as a polyimide film to form the insulating member 23.

Figure 7:
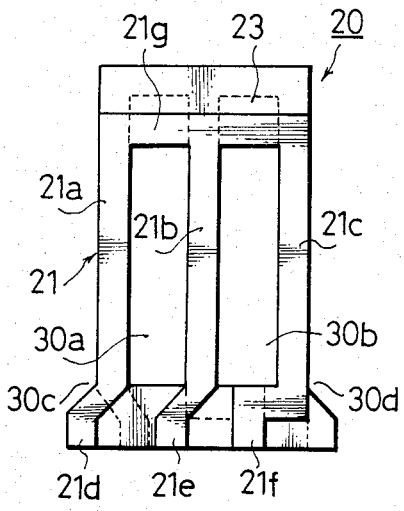
Figure 8:
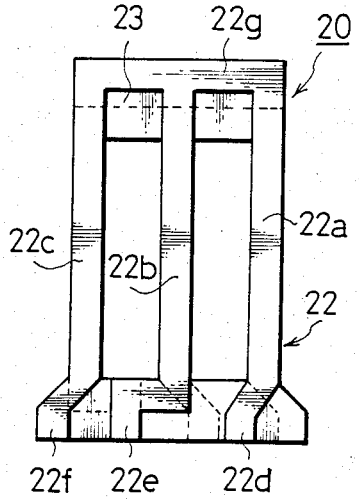
Figure 9A:
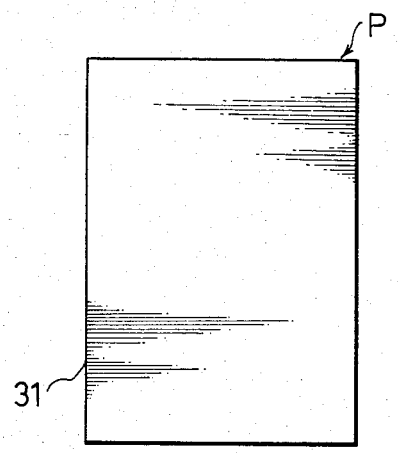
FIGS. 9A and 9C are plan views showing its production method.
Figure 9B:
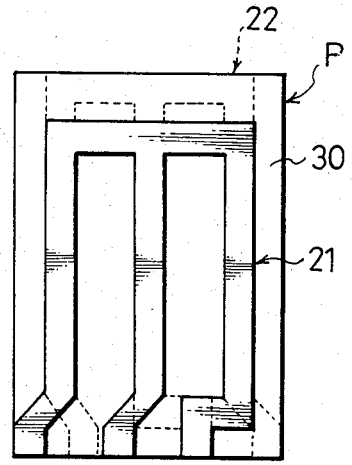
Figure 9C:
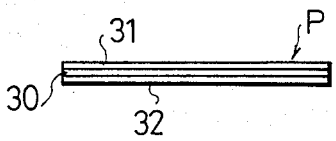
Figure 9D:
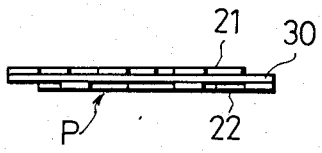

FIGS. 7 and 8 show another example of the electromagnetic coupling 20. In the drawings, like reference numerals are used to identify like constituents as in the foregoing embodiment and the explanation of these constituents is eliminated. The production method of the electromagnetic coupling 20 in this embodiment will be explained with reference to FIGS. 7 and 9A through 9D. First, as shown in FIGS. 9A and 9C, metallic materials 31, 32 such as a copper foil intended to serve as the first and second conductors 21, 22 are bonded to both surfaces of an insulating plate 30 consisting of a polyimide film or the like, thereby forming a printed substrate P. As shown in FIGS. 9B and 9D, the metallic materials 31, 32 are etched from the printed substrate P so as to form a substantially E-shaped first conductor 21 on one surface and a substantially E-shaped second conductor 22 on the other surface of the insulating plate 30. Next, as shown in FIG. 7, the insulating plate 30 is punched in the shape corresponding to the outer profile of the overlap portions 21*a*, 21*b*, 21*c* of the first conductor 21, thereby forming punch holes 30*a*, 30*b* and notches 30*c*, 30*d*.

In the electromagnetic coupling 20 thus produced, the first and second conductors 21, 22 are electrically insulated from each other by the insulating member 23 which is the insulating plate 30 and the coupling 20 can be formed by inserting the overlap portions 21*a*, 21*b*, 21*c*, 22*a*, 22*b*, 22*c* into the grooves 25*a*, 25*b*, 25*c* of the core 25 in the same way as in the foregoing embodiment. Since this embodiment uses the printed substrate P, the work for preventing the deviation of position of the relatively large second conductor 22 becomes unnecessary.

In accordance with the present invention, the electromagnetic coupling 20 consists of the first and second conductors 21, 22, each having at least three overlap portions, the terminals formed at one end each of the overlap portions and the connecting portion for connecting the other end each of the overlap portions, the insulating member 23 interposed between the first and second conductors 21, 22 and the two magnetic cores 24, 25 at least one of which has the three grooves, wherein the overlap portions of the first and second conductors 21, 22 are inserted into the grooves of the core while they are insulated from each other by the insulating member 23 and the two cores are bonded to each other while interposing the overlap portions between them. This arrangement eliminates the necessity of winding the paired wires on the ring-like toroidal cores as in the prior art device and makes it possible to produce the transformer by merely superposing the two cores 24, 25 with the electromagnetic coupling 20. Hence, the assembly of the transformer is not only simple but also can be automated. Since the overlap portions of the first and second conductors 21, 22 are superposed with one another via the insulating member 23, non-uniformity of the winding pitch of the paired wire in the conventional device can be eliminated and the resulting products have uniform characteristics. Furthermore, since the overlap portions are formed by the first and second conductors connected to each other by the connecting portions, the present invention eliminates the conventional steps of producing separately the first and second independent transformers $T_1$, $T_2$ by winding the paired wires on the two toroidal cores and then establishing a large number of connections between the transformers. The transformer of the present invention is simple in construction, needs only a limited wiring works and can be produced economically.

Figure 10:
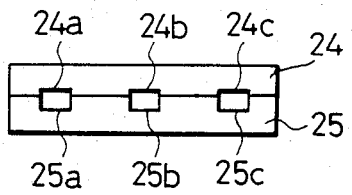
FIG. 10 is a side view of the core in accordance with still another embodiment of the present invention.

Additionally, FIG. 10 illustrates still another example of the cores, which are equipped with grooves 24*a*, 24*b*, 24*c* and 25*a*, 25*b*, 25*c* for storing therein the overlap portions of the electromagnetic coupling 20. This example is of course included in the scope of the present invention.

What is claimed is:

1. A transformer for converting an input signal to an output signal of different impedance comprising first and second conductors each being formed unitarily to have at least three overlap portions each having respective terminals at one end and an integral connection portion connecting the other ends of each of said overlap portions together; means including a member formed of insulating material and interposed between said first and second conductors electrically isolating said overlap portions of said first conductor from said overlap portions of said second conductor; and two discrete housing members each formed as a block of a magnetic substance and forming respective cores, at least one of said cores having three grooves; said overlap portions being placed in said grooves of said one core; said two cores being bonded to each other with said overlap portions between them to couple said overlap portions together electromagnetically, wherein said first and second conductors are arranged such that said connecting portions thereof do not superpose with each other.

2. The transformer as defined in claim 1 wherein said electromagnetic coupling is formed by use of a printed substrate produced by bonding a metallic material serving as said first and second conductors to both surfaces of an insulating plate.

3. A transformer for matching impedance between two portions of a circuit; comprising an assembly formed of first and second conductive portions having a sheet of insulating material therebetween, said conductive portions each having a plurality of elongate portions extending to respective terminal portions at one end portion thereof and a connecting portion formed integrally with the other end portion thereof to connect the elongate portions together electrically; and means including two discrete housing members formed by blocks of a magnetic material receiving said assembly for forming an electromagnetic coupling adapted to match impedance to portions of a circuit connected to respective terminal portions, one of said conductive portions having a length longer than the other so that said connecting portions need not overlap one another.

4. A transformer according to claim 3, said assembly being formed by bonding a metallic material to each face of said sheet of insulating material and removing portions of the metallic material to form said first and second conductors.

* * * * *